US005255403A

United States Patent [19]

Ortiz

[11] Patent Number: 5,255,403

[45] Date of Patent: Oct. 26, 1993

[54] BED CONTROL SUPPORT APPARATUS

[76] Inventor: Camilo V. Ortiz, 1221 Astoria Pl., Oxnard, Calif. 93030

[21] Appl. No.: 14,746

[22] Filed: Feb. 8, 1993

[51] Int. Cl.[5] ..... A47C 21/00

[52] U.S. Cl. ..... 5/503.1; 5/658; 5/905; 248/291; 248/231.8

[58] Field of Search ..... 5/503.1, 658, 905; 248/231.7, 231.8, 291

[56] References Cited

U.S. PATENT DOCUMENTS

| | | | |
|---|---|---|---|
| 1,500,057 | 7/1924 | Corns | 5/659 X |
| 2,434,360 | 1/1940 | Hess | 248/231.8 |
| 2,593,567 | 4/1952 | Keck | 5/503.1 X |
| 2,654,484 | 10/1953 | Win et al. | 5/503.1 X |
| 2,701,893 | 2/1955 | DeFazio | 5/503.1 |
| 4,023,757 | 3/1976 | Allard et al. | 248/231.7 X |

FOREIGN PATENT DOCUMENTS

| | | | |
|---|---|---|---|
| 0789207 | 7/1968 | Canada | 5/658 |

*Primary Examiner*—Michael F. Trettel
*Attorney, Agent, or Firm*—Leon Gilden

[57] ABSTRACT

An apparatus for permitting the pivotal positioning of a bed controller relative to an associated bed rail is provided to include a support bracket arranged for mounting to the bed rail, having an L-shaped support shaft pivotally mounted to the bracket. The support shaft includes a bifurcated head securing a controller device thereto.

6 Claims, 4 Drawing Sheets

BED CONTROL SUPPORT APPARATUS

BACKGROUND OF THE INVENTION

1. Field of the Invention

The field of invention relates to support apparatus, and more particularly pertains to a new and improved bed control support apparatus arranged for the ease and manipulation of a bed controller relative to the bed, such as utilized and employed in adjustable bed structure.

2. Description of the Prior Art

A remote controller housing structure is arranged for supporting a remote control as indicated in U.S. Pat. No. 4,991,892. The U.S. Pat. Nos. 3,543,312 and 4,938,153 are examples of bracket structure arranged for mounting in adjacency to a bed member.

The instant invention attempts to overcome deficiencies of the prior art by providing for a support bracket structure arranged for mounting relative to an associated bed frame rail for supporting a control unit thereto and in this respect, the present invention substantially fulfills this need.

SUMMARY OF THE INVENTION

In view of the foregoing disadvantages inherent in the known types of support apparatus now present in the prior art, the present invention provides a bed control support apparatus wherein the same is arranged to secure and mount a bed control unit thereto. As such, the general purpose of the present invention, which will be described subsequently in greater detail, is to provide a new and improved bed control support apparatus which has all the advantages of the prior art support apparatus and none of the disadvantages.

To attain this, the present invention provides an apparatus for permitting the pivotal positioning of a bed controller relative to an associated bed rail, to include a support bracket arranged for mounting to the bed rail, having an L-shaped support shaft pivotally mounted to the bracket. The support shaft includes a bifurcated head securing a controller device thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed control support apparatus which has all the advantages of the prior art support apparatus and none of the disadvantages.

It is another object of the present invention to provide a new and improved bed control support apparatus which may be easily and efficiently manufactured and marketed.

It is a further object of the present invention to provide a new and improved bed control support apparatus which is of a durable and reliable construction.

An even further object of the present invention is to provide a new and improved bed control support apparatus which is susceptible of a low cost of manufacture with regard to both materials and labor, and which accordingly is then susceptible of low prices of sale to the consuming public, thereby making such bed control support apparatus economically available to the buying public.

Still yet another object of the present invention is to provide a new and improved bed control support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
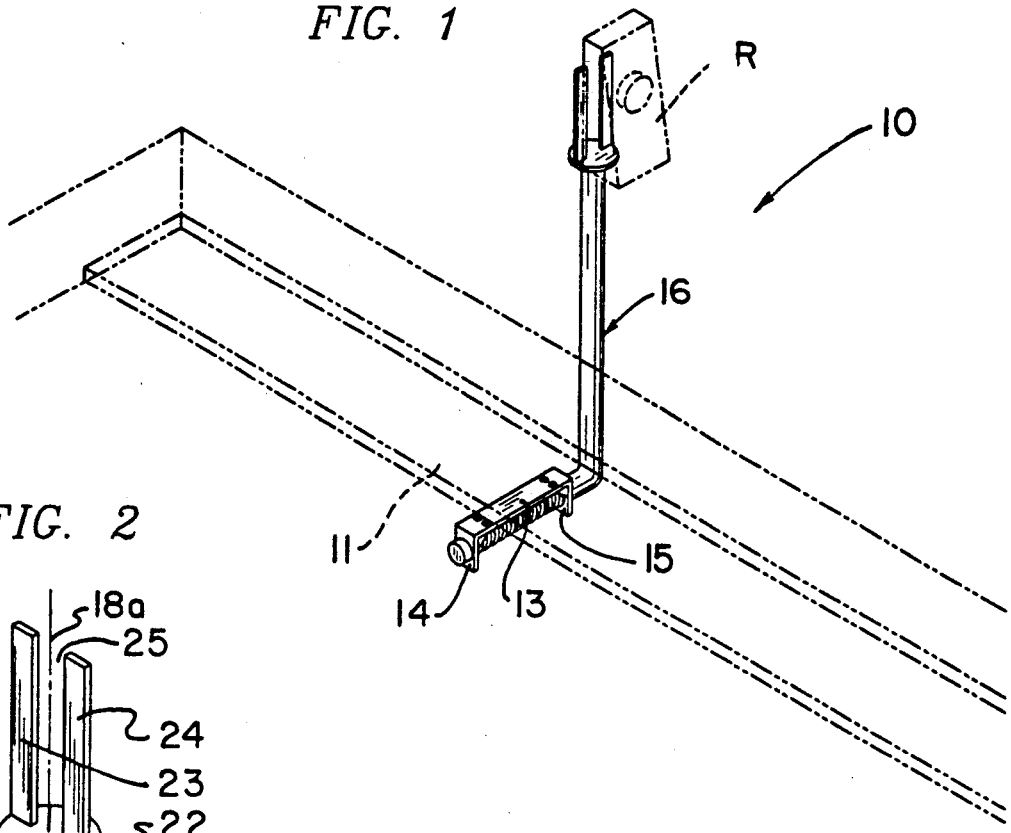
FIG. 1 is an isometric illustration of the invention mounted to an associated bed rail.
Figure 2:
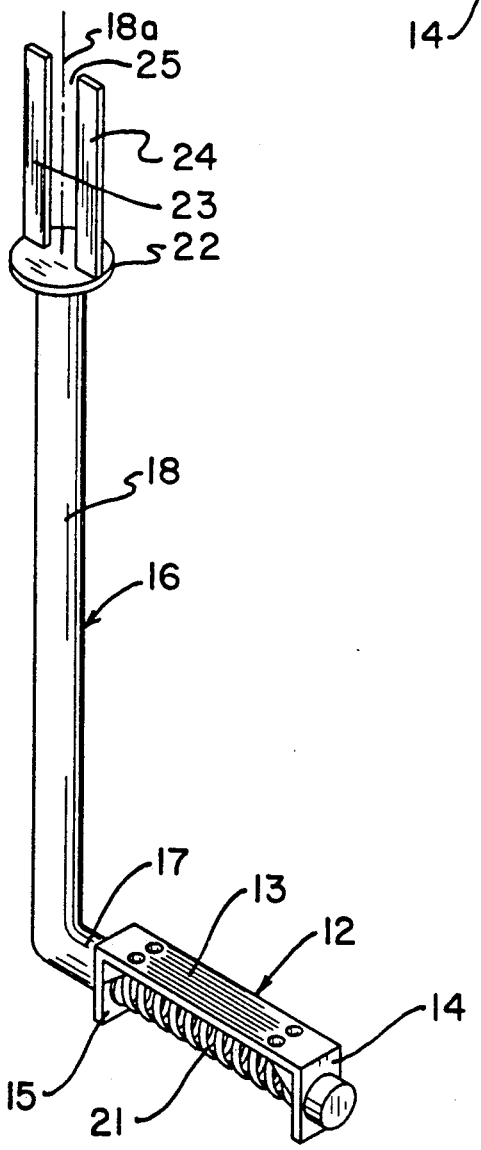
FIG. 2 is an enlarged isometric illustration of the invention.
Figure 3:
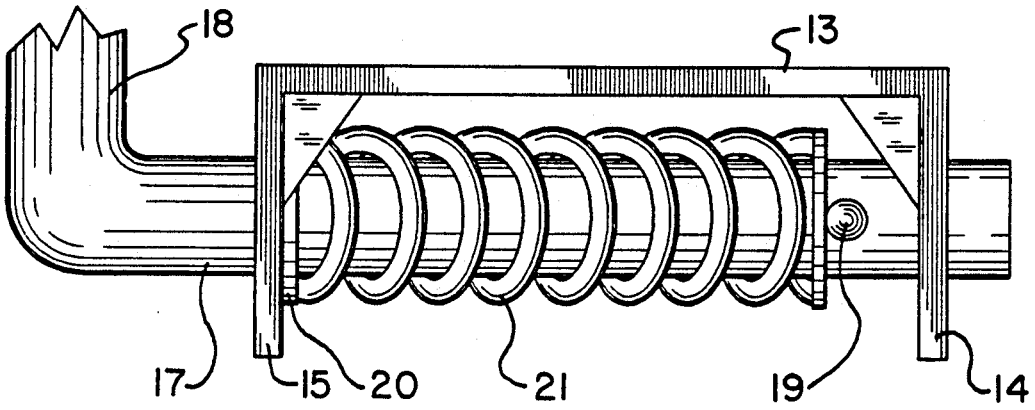
FIG. 3 is an isometric enlarged view of the support bracket structure receiving the L-shaped support shaft therethrough.

With reference now to the drawings, and in particular to FIGS. 1 to 8 thereof, a new and improved bed control support apparatus embodying the principles and concepts of the present invention and generally designated by the reference numeral 10 will be described.

More specifically, the bed control support apparatus 10 of the instant invention is arranged for mounting to a bed frame rail 11, as indicated in FIG. 1, by use of a U-shaped mounting bracket 12. The mounting bracket includes a mounting bracket base plate 13, having respective first and second leg plates 14 and 15 arranged parallel relative to one another in a coextensive relationship orthogonally oriented to the base plate receiving an L-shaped support shaft 16. The L-shaped support shaft 16 includes a first leg 17 pivotally and orthogonally directed through the first and second leg plates 14 and 15. A second leg 18 is orthogonally mounted to the first leg. An abutment pin 19 mounted to the first leg 17 between the first and second leg plates 14 and 15 include a spring member 21. A bearing cylinder 20 directed through the second leg plate 15 rotatably mounts the first leg 17. The spring 21 is directed between the second leg plate 15 and the abutment pin 19 to frictionally maintain the support shaft 16 in a predetermined angular orientation relative to the frame rail 11. The second leg includes a second leg head plate 22 orthogonally oriented relative to the axis 18*a* of the second leg 18, with respective first and second finger plates 23 and 24 arranged in a parallel coplanar relationship relative to one another defining a gap 25 therebetween, with the finger plates 23 and 24 orthogonally and fixedly mounted to the head plate 22. The gap 25 is arranged to frictionally receive the remote control housing "R" therebetween, or provide for an engaging surface for the remote control housing "R" when the first and second finger plates 23 and 24 are formed of a ferrometallic material to magnetically adhere the remote control housing "R" thereto. The FIG. 4 indicates the second leg 18 having a second leg cylindrical bore 27 receiving a head plate shaft 26 of the head plate 22 to rotatably mount the head plate 22 and the associated first and second finger plates relative to the L-shaped support shaft 16.

Figure 4:
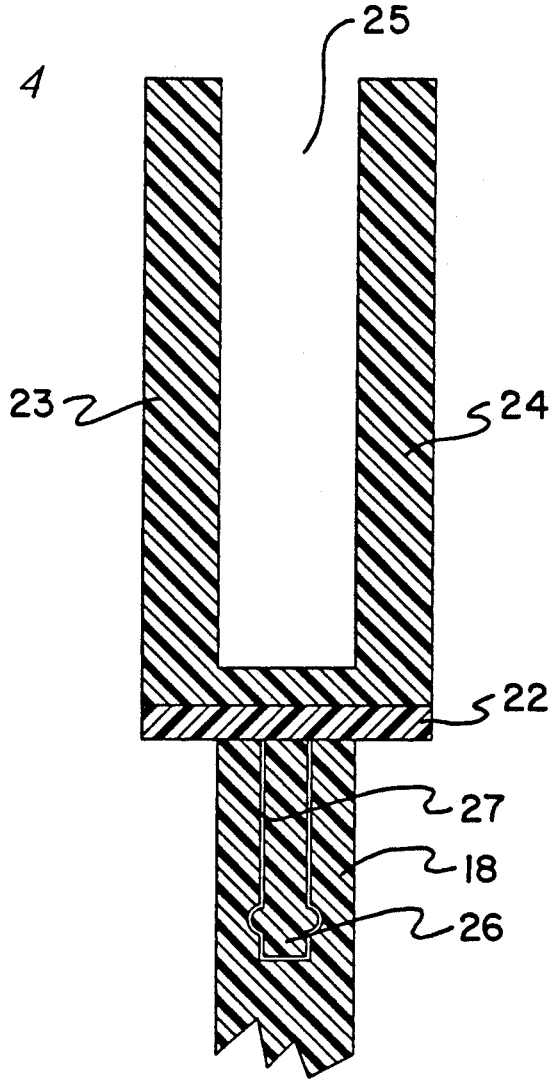
FIG. 4 is an orthographic cross-sectional illustration of the support head structure mounted to the support shaft of the invention.
Figure 5:
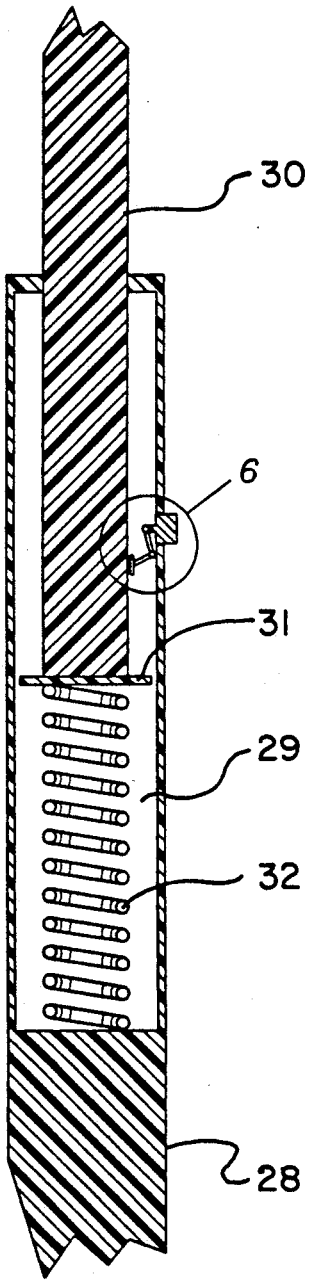
FIG. 5 is an orthographic cross-sectional illustration of a modified support shaft structure.
Figure 6:
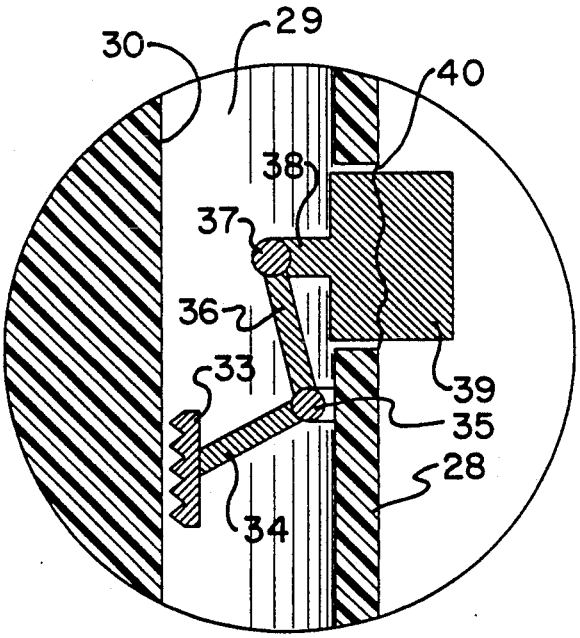
FIG. 6 is an enlarged orthographic view of section 6 as set forth in FIG. 5.

The FIG. 5 indicates the use of a modified second leg 28 telescopingly receiving an extension shaft 30, with the second leg 28 having a tubular cavity 29 receiving an extension shaft 30, with a first end of the extension shaft 30 having a first end plate 31 capturing a cavity spring 32 between the first end plate 31 and a floor of the tubular cavity 29. A friction pad 33 positioned within the tubular cavity 29 includes a first link 34 fixedly mounted to the friction pad 33, with a first pivot axle 35 pivotally mounting the first link 34 to a second link 36, with the first pivot axle 35 arranged for fixed attachment relative to an interior surface of the modified second leg 28. A second pivot axle 37 pivotally mounts the second link 36 to a third link 38 that in turn is arranged as a third link 38 fixedly mounted to a push button member 39 mounted through the second leg 28, with a waffle spring 40 normally biasing the push button member 39 exteriorly of the second leg 28. Upon manual projection of the push button member 39 into the tubular cavity 29, the friction pad 33 is displaced from the extension shaft 30 permitting selective extension and retraction of the extension shaft 30 relative to the modified second leg 28. The second end of the extension shaft 38 is arranged to include the second leg head plate 22 rotatably mounted thereto, in a manner as indicated in FIG. 4 and FIG. 7.

Figure 7:
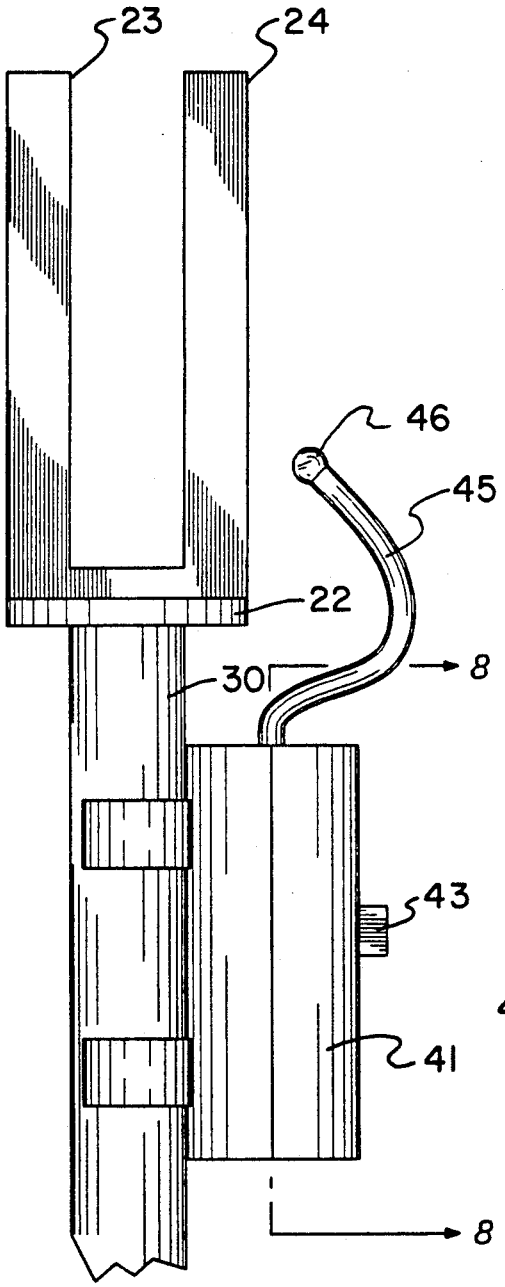
FIG. 7 is an orthographic view of the support shaft structure including an illumination housing.
Figure 8:
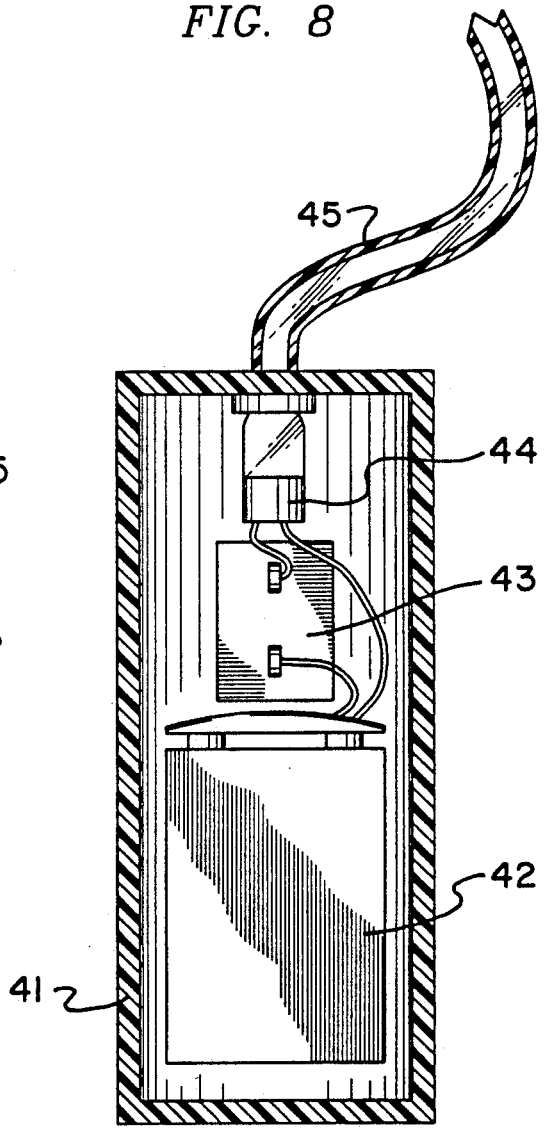
FIG. 8 is an orthographic view, taken along the lines 8—8 of FIG. 7 in the direction indicated by the arrows.

The FIGS. 7 and 8 include the further use of an illumination housing 41 mounted to the extension shaft 30. The illumination housing 41 includes a battery 42 mounted therewithin, as well as an on/off switch 43 in electrical communication with an illumination bulb 44 within the housing 41 to provide for selective illumination of the illumination bulb 44. A fiber optic cable 45 is provided, having a fiber optic cable first end directed into the housing 41 in adjacency to the illumination bulb 44. The second end of the fiber optic cable 45 projects exteriorly of the illumination housing 41 and terminates in a semi-spherical transparent lens 46 to provide for illumination of the gap 25 and the like between the first and second finger plates 23 and 24 to provide for illumination of the remote control housing "R" when positioned upon the second leg head plate structure for permitting use of the organization during periods of limited available light.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed control support apparatus for mounting to a bed frame rail, wherein the apparatus comprises, a U-shaped mounting bracket, the U-shaped mounting bracket including a base plate, the base plate having a first leg plate spaced from and parallel a second plate leg, with an L-shaped support shaft, the L-shaped support shaft including a first leg rotatably directed orthogonally through the first leg plate and the second leg plate, and a second leg fixedly and orthogonally mounted to the first leg, and an abutment pin directed through the first leg between the first leg plate and the second leg plate, and a spring member captured between the abutment pin and the second leg plate, and the second leg including a head plate, wherein the second leg is oriented about a second leg axis, and the head plate is orthogonally oriented relative to the axis, and a first finger plate and a second finger plate orthogonally and fixedly mounted to the head plate arranged for receiving a remote control housing thereon.

2. An apparatus as set forth in claim 1 wherein the first finger plate and the second finger plate define a gap therebetween for receiving the remote control housing therebetween.

3. An apparatus as set forth in claim 2 wherein the first finger plate and the second finger plate are formed of a magnetic material to magnetically adhere the remote control housing.

4. An apparatus as set forth in claim 3 wherein the second leg includes a second leg cylindrical bore, and the head plate includes a head plate shaft, and the head plate shaft is rotatably mounted within the second leg cylindrical bore.

5. An apparatus as set forth in claim 4 wherein the second leg includes a second leg extension shaft, wherein the extension shaft is telescopingly received within the second leg, and the extension shaft including an extension shaft first end having a first end plate, and the second leg having a tubular cavity receiving the extension shaft, with the tubular cavity having a cavity floor, and a cavity spring captured between the cavity floor and the first end plate, and a friction pad arranged for positioning within the tubular cavity in engagement with the extension shaft, the friction pad having a first link and a second link, with a first pivot axle pivotally mounting the first link to the second link, and the first pivot axle arranged and mounted to the second leg within the tubular cavity, and a third link, with a second pivot axle pivotally mounting the second link to the third link, and the third link including a push button member mounted through the second leg, with the push button member including a waffle spring mounted to the push button member to bias the push member exteriorly of the second leg.

6. An apparatus as set forth in claim 5 including an illumination housing mounted to the extension shaft, with the illumination housing including a battery and an on/off switch directed through the illumination housing, and an illumination bulb within the illumination housing, wherein the on/off switch effects selective illumination of the illumination bulb, and a fiber optic cable, the fiber optic cable including a cable first end directed into the illumination housing in adjacency to the illumination bulb, the fiber optic cable including a second end, the second end having a semi-spherical transparent lens arranged for positioning in adjacency to the remote control housing and the first finger plate and the second finger plate.

* * * * *